United States Patent [19]

Kakino et al.

[11] Patent Number: 4,671,160

[45] Date of Patent: Jun. 9, 1987

[54] METHOD FOR SUPPLYING A WATER-IN-OIL EMULSION EXPLOSIVE INTO A CARTRIDGE MACHINE AND AN APPARATUS USED THEREFOR

[75] Inventors: Shigeru Kakino, Chita; Hideo Moriyama, Tokoname; Kazutoshi Sugimoto; Tsukasa Motohira, both of Chita, all of Japan

[73] Assignee: Nippon Oil and Fats Company, Limited, Japan

[21] Appl. No.: 742,913

[22] Filed: Jun. 10, 1985

[30] Foreign Application Priority Data

Jun. 15, 1984 [JP] Japan ..... 59-122116

[51] Int. Cl.[4] ..... B01J 13/00; B67D 5/40; F42B 37/00; C06B 21/00

[52] U.S. Cl. ..... 86/20.1; 86/20.14; 86/47; 264/3.1; 222/387

[58] Field of Search ..... 252/309; 264/3.1; 149/19.92; 86/47, 20 R, 20 D; 53/473; 222/63, 189, 525, 387

[56] References Cited

U.S. PATENT DOCUMENTS

| | | | |
|---|---|---|---|
| 1,340,737 | 5/1920 | Paulson | 86/47 |
| 3,562,364 | 2/1971 | Caudle et al. | 264/3.1 |
| 4,098,189 | 7/1978 | Holm | 264/3.1 X |
| 4,410,378 | 10/1983 | Hattori et al. | 264/3.1 X |
| 4,420,440 | 12/1983 | Marz | 264/3.1 X |

FOREIGN PATENT DOCUMENTS

| | | |
|---|---|---|
| 921018 | 12/1954 | Fed. Rep. of Germany . |
| 1227209 | 8/1960 | France . |
| 34095 | 2/1982 | Japan . |
| 56700 | 4/1984 | Japan . |

OTHER PUBLICATIONS

European Search Report for European Patent Application No. 85 30 4199.4.

*Primary Examiner*—Peter A. Nelson
*Assistant Examiner*—Catherine S. Kilby
*Attorney, Agent, or Firm*—Parkhurst & Oliff

[57] ABSTRACT

A feeder comprising a hopper and a pusher, the pusher comprising a pusher sleeve, which is provided at its bottom with a perforated plate, and a cylinder actuating the pusher sleeve along the wall surface of the hopper, which directly supplies a W/O emulsion explosive into a cartridge machine without mixing with air and without breakage of hollow microspheres.

4 Claims, 3 Drawing Figures

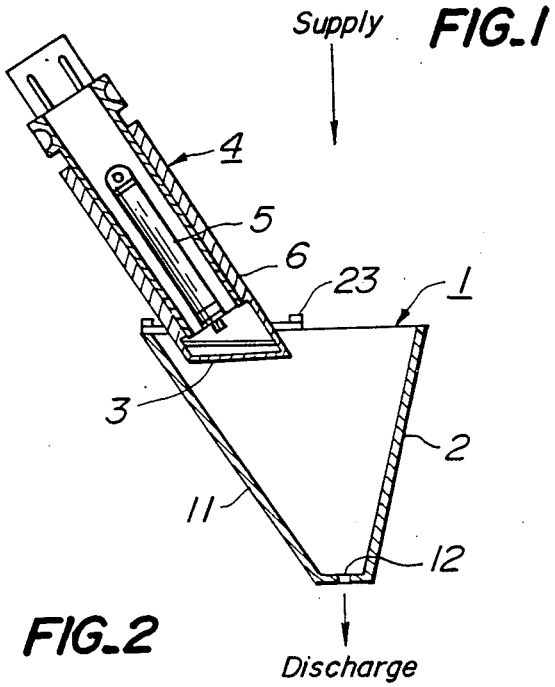
FIG. 2
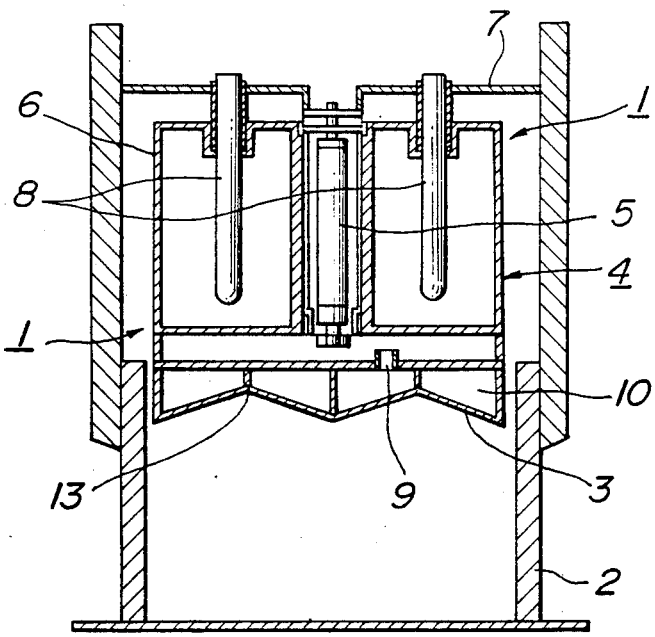

METHOD FOR SUPPLYING A WATER-IN-OIL EMULSION EXPLOSIVE INTO A CARTRIDGE MACHINE AND AN APPARATUS USED THEREFOR

BACKGROUND OF THE INVENTION (1) Field of the Invention

The present invention relates to a method for supplying a water-in-oil (hereinafter, abbreviated as W/O) emulsion explosive into a cartridge machine, and an apparatus used for the method; and more particularly relates to a method for supplying a W/O emulsion explosive into a cartridge machine, which method has made possible to pack even a W/O emulsion explosive having very low consistency by means of the cartridge machine, and an apparatus (hereinafter, referred to as "feeder") used for the method.

(2) Description of the Prior Art

There has heretofore been used a cartridge machine (for example, Rollex cartridge machine, made by Niepmann Jmbh & Co.) for gelatin dynamite in the packing of a W/O emulsion explosive in a paper tube.

However, W/O emulsion explosives capable of being packed by this cartridge machine are limited to ones having high consistency, and it is difficult to pack W/O emulsion explosive having low consistency due to the fact that explosives having low consistency to every portions in the cartridge machine due to their high adhesion.

The reason why such troubles occur is that the cartridge machine for gelatin dynamite is designed for packing rigid, plastic and non-adhesive gelatin dynamite.

A W/O emulsion explosive generally has a temperature higher than 80° C. after kneading during the course of the production of the explosive due to the properties of the starting raw materials, and is generally soft and adhesive. Accordingly it is difficult to directly pack the soft and adhesive explosive by means of the above described cartridge machine unless the explosive is modified into a rigid, plastic and non-adhesive explosive. Therefore, the soft and adhesive explosive has heretofore been packed after the explosive had been modified into form by cooling.

However, this requires a cooling step to be used for the cooling of the W/O emulsion explosive. Further, natural cooling requires a long period of time (for example, several tens of hours) due to the poor heat transfer coefficient of the W/O emulsion explosive.

There has been proposed a method in Japanese Patent Laid-open Specification No. 34,095/82, wherein a specifically limited petroleum wax is used as a carbonaceous fuel constituting the continuous phase of a W/O emulsion explosive in order to improve the consistency of the explosive.

However, even in the above proposed method, it is necessary to cool the raw material mixture containing the petroleum wax to a temperature lower than the melting point of the petroleum wax, and moreover the kind and amount of the carbonaceous fuels to be used in the above proposed method must be selected from narrow ranges respectively due to the fact that petroleum wax is an essential ingredient as a carbonaceous fuel in the explosive.

Accordingly, there has been great demand to develop a method capable of packing a W/O emulsion explosive having a low consistency by means of a cartridge machine without the use of a cooling step and further without narrowly limiting the composition of the explosive.

SUMMARY OF THE INVENTION

The inventors have investigated in order to solve the above described problems in the conventional methods, and ascertained that the problems can be solved by carrying out a specifically limited method between the kneading step and the packaging step in the production of a W/O emulsion explosive, and have accomplished the present invention.

One of the features of the present invention lies in a method for supplying continuously or intermittently a W/O emulsion explosive into a cartridge machine, the improvement comprising receiving the W/O emulsion explosive in a hopper, uniformly dispersing the explosive in the hopper without mixing with air, and quantitatively discharging the explosive from the lower portion of the hopper.

Another feature of the present invention lies in a feeder used for the method of the present invention, comprising a pusher and a hopper, the pusher comprising a pusher sleeve, which is provided at its bottom with a perforated plate, and a cylinder actuating the pusher sleeve along the wall surface of the hopper.

BRIEF DESCRIPTION OF THE DRAWINGS

FIG. 1 is a sectional side view of one embodiment of the feeder of the present invention;

FIG. 2 is a sectional front view of the feeder illustrated in FIG. 1.

DESCRIPTION OF THE PREFERRED EMBODIMENT

Figure 3:
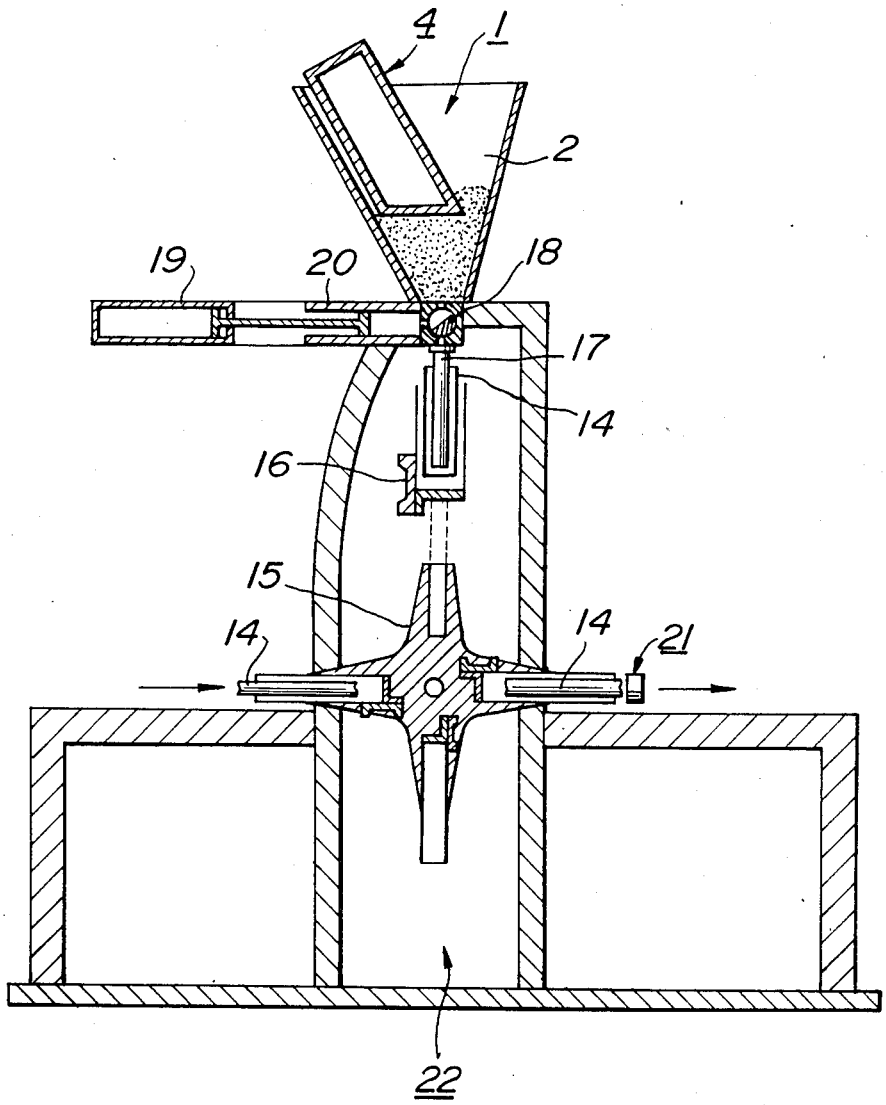
FIG. 3 is an explanative view illustrating one embodiment of a method for packaging a W/O emulsion explosive by connecting the feeder of the present invention to a cartridge machine.

Referring to FIGS. 1 and 2, a feeder 1 according to the present invention comprises a pusher 4 and a hopper 2. The pusher 4 comprises a pusher sleeve 6 provided at its bottom with a perforated plate 3, and a cylinder 5 actuating the pusher sleeve 6.

A W/O emulsion explosive is continuously or intermittently supplied directly into the hopper 2 from a kneader without cooling. When the amount of the supplied W/O emulsion explosive reaches a preset level for the amount of explosive in the hopper (which has been preset in the hopper depending upon the amount of the explosive to be supplied to a cartridge machine), a hydraulic cylinder 5 is actuated to push down the pusher sleeve 6 into the hopper 2 along a pusher guide 8 fixed to a pusher base 7. By the downward movement of the pusher sleeve 6, a W/O emulsion explosive is forcedly pushed into the hopper and is spread and uniformly dispersed therein. However, during the downward movement of the pusher sleeve 6, when a load higher than a certain load is applied to the pusher 4, a safety device (which is not shown in the drawings, and is, for example, a hydraulic circuit safety value, an overload-preventing relay for power supply source in hydraulic circuit, or the like) is actuated to stop the downward movement of the pusher sleeve 6. Further, the feeder 1 has such a structure that, when the amount of a W/O emulsion explosive to be supplied into the hopper 2 greatly exceeds the preset level or is decreased to the amount much smaller than the present level, the extraordinary state is transmitted to a sensor, which is not shown in the drawings, and is, for example, an electrostatic capacity type level meter, an ultrasonic wave level meter or the like.

When the pusher sleeve 6 goes down at a constant velocity in the hopper 2, air incorporated into the W/O emulsion explosive is gathered into recesses 13 formed underside of the perforated plate 3, which is arranged on the bottom of the pusher sleeve 6, by the action of the shape, for example a corrugated shape or the like, of the bottom surface of the pusher sleeve 6 (refer to FIG. 2), whereby the W/O emulsion explosive is deareated and defoamed.

The pusher sleeve 6, after descending to a lower portion in the hopper 2 (the position, to which the pusher sleeve 6 is to descend, can be freely preset), compressed air is supplied into an air chamber 10 for a given period of time under a given pressure through a feed nozzle 9 arranged on the lower portion of the pusher so as to effect an air purge towards the W/O emulsion explosive through the perforated plate 3 located at on the bottom of the pusher sleeve 6. This air purge is carried out in order to prevent, when the pusher sleeve 6 moves upwardly, the uniformly dispersed W/O emulsion explosive in the hopper adhering to the bottom of the pusher sleeve 6, and the W/O emulsion explosive in the hopper can not be continuously supplied into a cartridge machine under a constant pressure.

The number of descending times per hour and the descending velocity of the pusher sleeve 6 can be freely selected depending upon the state and viscosity of the W/O emulsion explosive, the supplying capacity of the kneader, and the treating capacity of the cartridge machine, and the like.

The perforated plate 3 located at the bottom of the pusher sleeve 6 is preferably made of sintered metal, because a perforated plate made of sintered metal is used, the air purge can be effected through out the whole area of the bottom surface of the pusher sleeve, and even a W/O emulsion explosive having a very high adhesion can be prevented from adhering to the perforated plate.

In FIG. 1, the numeral 23 represents a scraper used for scraping a W/O emulsion explosive adhered to the side surface of the pusher sleeve.

The bottom surface of the pusher sleeve is preferably in parallel with the discharge hole 12 arranged on the lower portion of the hopper (bottom surface of the hopper) in order to improve the accuracy in supplying of a W/O emulsion explosive into the cartridge machine. The term "parallel" herein used means, when the bottom surface of a pusher sleeve has a corrugated shape, the corrugated bottom surface of the pusher sleeve is macroscopically parallel with the bottom surface of the hopper.

It is preferable that the hopper 2 has a relatively gentle inclination in the wall surface 11 at the side, to which the pusher 4 is fixed, and has a steep inclination in the wall surface opposed to the wall surface 11. The reason being the W/O emulsion explosive supplied from the kneader can be easily supplied into the hopper 2, and the pusher 4 can be effectively operated.

The interior of the hopper 2 can be easily cleaned by forcedly ascending the pusher 4 up to the upper portion of the hopper.

When a plural number of pushers are arranged in one hopper or a plural number of discharge holes are arranged on the lower portion of one hopper, the capacity of the hopper for supplying the W/O emulsion explosive into the cartridge machine can be increased.

A W/O emulsion explosive discharged from the feeder of the present invention according to the above described procedure is supplied into, for example, a cartridge machine explained hereinafter and packed by means of the machine.

Referring to FIG. 3, a paper tube 14 previously heled in a holder 16 is set in a revolver 15, and the revolver 15 is turned by 90° and is directed upright. Then, the holder 16 is moved uprightly up to the position of a nozzle 17 such that the paper tube 14 to be packed with a W/O emulsion explosive is brought up near the root of the nozzle 17.

A W/O emulsion explosive, which has been supplied into a feeder 1 from a kneader or the like, is uniformly dispersed in a hopper 2 without mixing with air by the action of the pusher 4, and then a given volume of the explosive is sucked into a suction cyliner 20 through a rotary valve 18 by the action of a hydraulic cylinder 19.

After the suction, the rotary valve 18 is turned by 90° to be changed closed at the hopper 2 side and opened at the nozzle 17 side. At the same time, the hydraulic cylinder 19 is actuated in a direction so as to discharge the W/O emulsion explosive, which has been sucked into the suction cylinder 20. In this case, the paper tube 14, which is being packed with the W/O emulsion explosive, is gradually moved downwardly together with the downward movement of the holder 16 corresponding to the packing velocity of the explosive. After completion of the packing, the revolver 15 is further rotated, and the paper tube 14 packed with the explosive is sealed at the packing mouth side by means of a sealing mechanism 21, and then discharged from the revolver 15, whereby the packing of the W/O emulsion explosive is completed. In FIG. 3, the numeral 22 represents a cartridge machine.

The present invention will be explained concretely by the following examples.

EXAMPLE

A W/O emulsion produced by mixing, on a weight basis, 74.7 parts of ammonium nitrate, 4.5 parts of sodium nitrate, 10.7 parts of water, 3.4 parts of paraffin and 1.7 parts of an emulsifier in an emulsifying machine was further mixed with 5 parts of hollow microspheres, and the resulting mixture was kneaded in a kneader to produce a W/O emulsion explosive. The resulting W/O emulsion explosive had a viscosity of about 20,000 poises at a temperature of 90° C. (measured by means of a rotation viscometer).

This W/O emulsion explosive was continuously supplied into a feeder 1 illustrated in FIG. 2. The hopper 2 of the feeder 1 was heated by flowing warm water kept at 90° C. in a hopper jacket (not shown in the drawings).

The W/O emulsion explosive supplied into the hopper 2 rose locally in the hopper just after the supply, but was uniformly dispersed in the hopper 2 by the up and down movements of the pusher sleeve 6 at a velocity of 0.03 m/sec and at a rate of one cycle per 2 minutes.

The W/O emulsion explosive adhered to the bottom portion of the pusher sleeve 6, and when the pusher sleeve 6 was moved upwardly, all of the W/O emulsion explosive would be likely to be brought up. However, the explosive was able to be completely peeled from the pusher sleeve 6 by an air purge in an amount of about 1 kg/m$^2$ through the entire area of the perforated plate 3 (made of sintered metal) located at the bottom of the pusher sleeve 6.

The W/O emulsion explosive uniformly dispersed in the hopper 2 was supplied into a cartridge machine illustrated in FIG. 2 to produce cartridges of the W/O emulsion explosive packed in the paper tube.

From the resulting cartridges, 60 cartridges were sampled and the loading amount of the explosive in each cartridge was measured, and the dispersion of the loading amounts was examined.

The results obtained are shown in the following Table 1.

Further, the above obtained 60 cartridges were used, and the density of the explosive at 20° C., the stiffness by needle-penetration (indicated by the penetrated value (mm) of an iron conical needle (apex: 30°) having a weight of 133 g into the explosive in the case where the needle was dropped from a height of 45 mm on the explosive at 20° C., the detonation velocity of the explosive at 20° C. (m/sec., by the uses of No. 6 blasting cap) were measured, and the average values of these properties were calculated.

The results obtained are shown in the following Table 2.

Further, in order to examine that the performance of the W/O emulsion explosive was not changed due to the use of the above described feeder of the present invention, the W/O emulsion explosive discharged from the kneader was packed in paper tubes by hand to produce cartridges of the W/O emulsion explosive packed in the paper tubes, and the density, the stiffness by needle-penetration, and the detonation velocity of the cartridges were measured in the same manners as described above. The results obtained are also shown in Table 2.

The hopper used in the experiments of the present invention had a quadrangular frustrum having a height of 700 mm, a top surface of 500 mm length and 500 mm width, and a bottom surface of 78 mm length and 500 mm width. The pusher sleeve used in the experiments had such a shape that the top surface had a length of 250 mm and a width of 450 mm, and that the sleeve length was 350 mm and the stroke length was 250 mm.

The number of nozzles 17 for packing the explosive, which were connected to the lower portion of the hopper, was 7.

COMPARATIVE EXAMPLE

An experiment for packing a W/O emulsion explosive in paper tubes was effected in the same manner as described in the above Example, except that a feeder which had only the hopper and had not the pusher, was used.

The W/O emulsion explosive supplied into the hopper was not uniformly dispersed in the hopper, and a large number of projections probably due to voids were observed all over the surface of the explosive.

Then, the W/O emulsion explosive in the hopper was supplied into the same cartridge machine as used in the Example and was formed into cartridges of the W/O emulsion explosive packed in the paper tubes. Among the resulting cartriges, 60 cartridges were sampled, and the loading amount of the explosive in each cartridge was measured, and the dispersion of the loading amounts was examined.

The results obtained are also shown in Table 1.

TABLE 1

| | Example | Comparative Example |
|---|---|---|
| Loading amount, $\bar{x}$ (g) | 102.99 | 66.30 |
| Standard deviation, $\delta$ (g) | 0.96 | 17.05 |

*Number of samples: 60

It can be seen from Table 1 that, the poor accuracy in the loading amount in the comparative example is due to the mixing with air.

TABLE 2

| | After kneading | (20° C.) Example |
|---|---|---|
| Density | 1.09 | 1.10 |
| Stiffness in needle-penetration (mm) | 15.0 | 15.0 |
| Detonation velocity (mm/sec) | 5,100 | 5,050 |

The reason why the performance of the W/O emulsion explosive of the comparative example is not shown in Table 2 is that the accuracy in the packing of the explosive in the paper tube is too poor to evaluate the performance of the explosive of the Comparative example.

As seen from the Example, according to the present invention, a W/O emulsion explosive can be supplied directly into a cartridge machine from a kneader and the like without cooling, and moreover a cartridge obtained by packing the W/O emulsion explosive in a paper tube has a satisfactorily high performance due to the fact that the explosive can be packed in a paper tube without mixing with air and without breakage of the hollow microspheres.

What is claimed is:

1. An apparatus for feeding a water-in-oil emulsion explosive to a cartridge machine, said apparatus being located between a kneader or an emulsifying and kneading machine and said cartridge machine, said apparatus comprising:

a hopper and a pusher, said pusher comprising a pusher sleeve having a bottom portion including a perforated plate having a substantially corrugated shape; and a cylinder for actuating said pusher sleeve along a first wall surface of said hopper.

2. An apparatus according to claim 1, wherein said perforated plate is substantially parallel with an emulsion discharge hole located at a bottom portion of said hopper.

3. An apparatus according to claim 1, wherein said perforated plate is made of sintered metal.

4. An apparatus according to claim 1, wherein said first wall surface of said hopper is inclined more gently with respect to a horizontal plane than a second wall surface of said hopper opposed to said first wall surface.

* * * * *